United States Patent [19]

Kraemer

[11] 4,251,934

[45] Feb. 24, 1981

[54] OPEN ENDED BAG LABEL

[76] Inventor: John A. Kraemer, 3025 Simpson St., Roseville, Minn. 55113

[21] Appl. No.: 922,034

[22] Filed: Jul. 5, 1978

[51] Int. Cl.[3] ..... G09F 3/00

[52] U.S. Cl. ..... 40/2 R; 229/52 B

[58] Field of Search ..... 229/52 B, 39 R; 40/2 R, 40/21 R

[56] References Cited

U.S. PATENT DOCUMENTS

| | | | |
|---|---|---|---|
| 2,059,092 | 10/1936 | Donovan | 40/2 R |
| 2,873,905 | 2/1959 | Denton | 40/2 R |
| 3,141,597 | 7/1964 | Palmer | 229/52 B |
| 4,062,487 | 12/1977 | Bliss | 229/52 B |

FOREIGN PATENT DOCUMENTS 27575 of 1897 United Kingdom .

*Primary Examiner*—John W. Shepperd

[57] ABSTRACT

The open ended bag label is a folded rectangular paper shape that is folded around an open ended bag and allows for the removal and replacement of the bag contents without removing the label.

2 Claims, 3 Drawing Figures

3
11
11
9
8
1
7
5
4
6

8
7
11
11
3
9
4
1
5
2

11
10
3
1
2

OPEN ENDED BAG LABEL

SUMMARY OF INVENTION

The present invention is a method of utilizing a folded rectangular or square paper shape to form an open ended bag label. There are presently no known open ended bag labels that provide optimum versatility, durability, and economy of paper use.

OPERATION OF INVENTION

The open ended bag label allows the bag contents to be removed and replaced without removing the label. All exposed edges of the paper label are folded for greater durability. Also, the display hang hole is punched through a minimum of four paper thicknesses for greater tear resistant strength. In addition, both sides of the paper label can be utilized to provide additional advertisement, information and/or instruction.

It is intended that the open ended bag label be utilized to hang merchandise for display and allow the bag contents to be inspected without removing the label from the bag.

DESCRIPTION OF INVENTION

The open ended bag label is a folded rectangular or square paper shape of a size based upon the width of the bag to be suspended from it. The folds are formed at parallels to the dimensions of the paper shape. Opposing acute angle folds are made from points equidistant from the ends opposite the folded side of the paper. The distance between angles is determined by the width of the bag. The degree of angle fold is determined by the proportional dimensions of the folded paper. The bag is placed inside the folded label and secured to the label at the desired position along its length. The angled folds allow the folded ends of the paper to overlap and mesh together so that the folded corners interlock to form a point. The exposed loose end of the label is secured to the label with adhesive or other appropriate fasteners.

The folded label, when secured to the exterior of an open ended bag, provides access to the bag contents without having to remove the label. The label can be opened to reveal the opposite side of the fold and the opposite side of the paper label.

DESCRIPTION OF DRAWINGS

Other objects and attendant advantages will be appreciated by those skilled in this art as the invention becomes better understood by reference to the accompanying drawings, in which.

Figure 1:
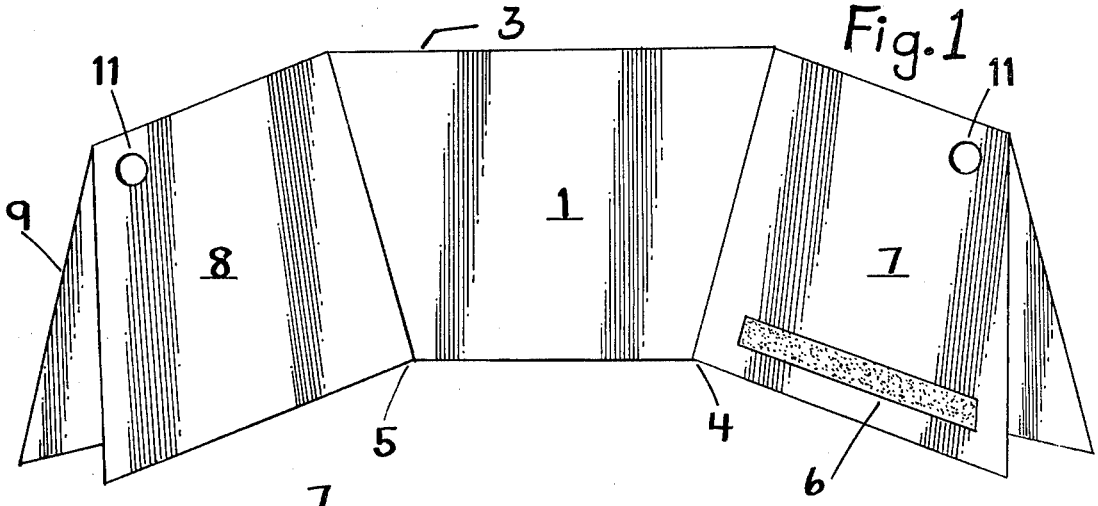
FIG. 1 is a perspective view of the label structure embodying the types of folds utilized in forming the open ended bag label and illustrating the location of adhesive or fasteners for securing the bag to the label and the exposed end of the label.

Referring to the drawings, the bag designated generally by reference number 2 may be of any size and material suitable for the use to which the bag or receptacle is intended. The folded label designated by reference number 1 is of a size and proportions corresponding to the bag width at the open end of the bag.

FIG. 1 illustrates the parallel fold 3 made to the length dimension of the rectangular paper shape and the intersecting opposing acute angle folds 4 and 5 necessary to form the open ended label. Bag 2 is positioned inside of the folded paper label so that the width dimension of the bag aligns with the acute angle folds 4 and 5. The adhesive coated area 6 secures the bag to the label.

Figure 2:
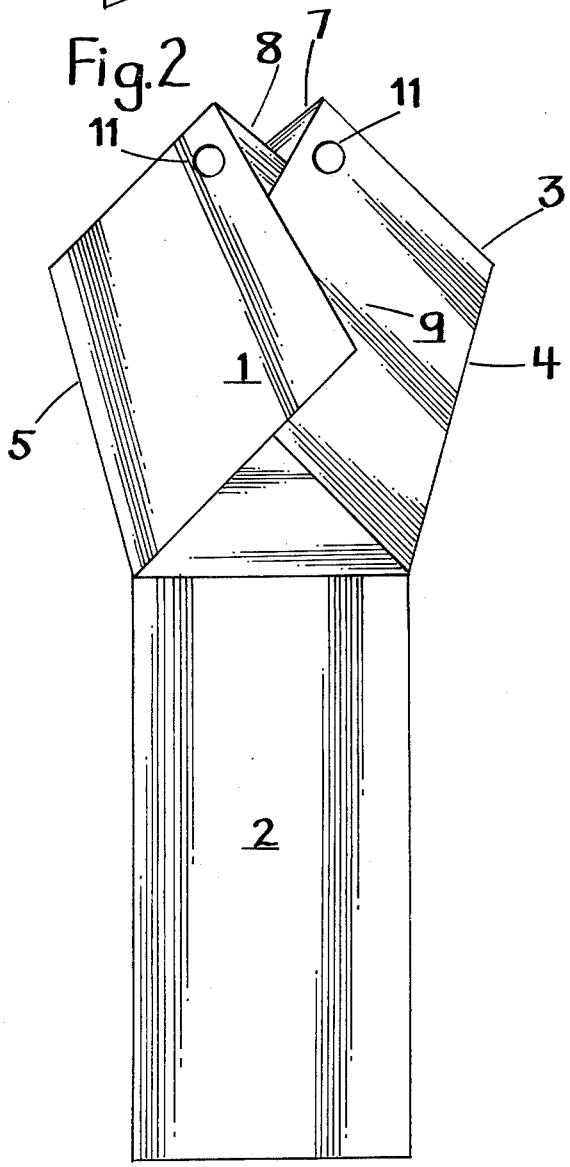
FIG. 2 is a back view of the label structure and illustrates the folded open ended label prior to insertion and attachment of an open ended bag.

FIG. 2 illustrates the method of meshing the ends of the paper label so as to interlock the folded corners. The location of the hang hole and the adhesive coated area for securing the loose end of the label are also illustrated. The ends of the paper label are meshed together in such a way that the adhesive coated end 7 is to the inside of the folded label. Side 8 is inserted into the fold created by side end 7 and moved to a position so that the folded corners of the opposite ends come together to interlock and form a point. The end corner of side 9 is loose and secured to the back of the label with adhesive.

Figure 3:
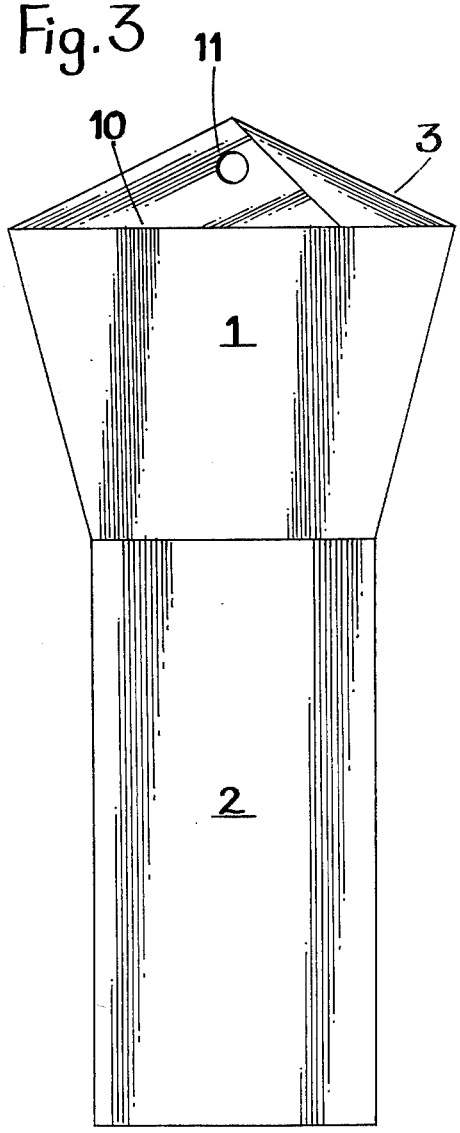
FIG. 3 is a front view of the open ended bag label after attachment of an open ended bag.

FIG. 3 is a frontal view of the label after attachment of the bag to the label. The opening 10 that allows the bag contents to be removed and replaced, opens to a wider dimension than the bag width. The hang hole 11 is a punched hole through the overlapping ends of the folded paper label. The bag is positioned and secured to the inside of the label with adhesive.

In view of the foregoing disclosures, variations or modifications will be apparent, and it is intended to include within the invention all such variations and modifications except as do not come within the scope of the claims.

Having thus described the invention, it is claimed:

1. The open ended bag label is a rectangular sheet of paper folded parallel to the length further folds from the first fold to the edge of the paper parallel to the first fold at an acute angle to define sides that are trapazoids with the short edge along the first fold, the sides are folded and meshed together to have the corners of the sides along the first fold intersect to form a point above the first fold, means to secure the overlapping sides together and means to secure the open ended bag to the inside of the label such that the label defines a flaired opening to facilitate removal and replacement of the bag contents.

2. The open ended bag label of claim 1 wherein a hole is formed in the overlapping paper below the point.

* * * * *